US010801281B2

(12) United States Patent
Fontenot et al.

(10) Patent No.: US 10,801,281 B2
(45) Date of Patent: Oct. 13, 2020

(54) METHOD AND APPARATUS FOR AUTONOMOUS INJECTABLE LIQUID DISPENSING

(71) Applicant: Pro-Ject Chemicals, Inc., The Woodlands, TX (US)

(72) Inventors: David Fontenot, Katy, TX (US); Jason Metzenthin, Houston, TX (US)

(73) Assignee: Pro-Ject Chemicals, Inc., The Woodlands, TX (US)

( * ) Notice: Subject to any disclaimer, the term of this patent is extended or adjusted under 35 U.S.C. 154(b) by 64 days.

(21) Appl. No.: 15/964,677

(22) Filed: Apr. 27, 2018

(65) Prior Publication Data

US 2019/0330939 A1 Oct. 31, 2019

(51) Int. Cl.

| | |
|---|---|
| ***E21B 21/08*** | (2006.01) |
| ***E21B 37/06*** | (2006.01) |
| ***E21B 43/16*** | (2006.01) |
| ***E21B 41/02*** | (2006.01) |

(52) U.S. Cl.

CPC ..... *E21B 21/08* (2013.01); *E21B 37/06* (2013.01); *E21B 41/02* (2013.01); *E21B 43/162* (2013.01)

(58) Field of Classification Search

CPC ..... E21B 21/08; E21B 37/06; E21B 41/02; E21B 43/162

See application file for complete search history.

(56) References Cited

U.S. PATENT DOCUMENTS

| | | | | |
|---|---|---|---|---|
| 6,176,323 | B1 * | 1/2001 | Weirich | E21B 21/08 175/40 |
| 7,255,173 | B2 * | 8/2007 | Hosie | E21B 21/08 166/250.01 |
| 7,398,680 | B2 * | 7/2008 | Glasbergen | E21B 47/1005 374/136 |
| 8,408,314 | B2 * | 4/2013 | Patel | E21B 37/06 166/306 |
| 9,255,465 | B2 | 2/2016 | Smith, IV | |
| 9,388,686 | B2 * | 7/2016 | Konopczynski | E21B 47/102 |
| 9,708,867 | B2 * | 7/2017 | Lovell | E21B 34/06 |
| 9,988,900 | B2 * | 6/2018 | Kampfer | E21B 43/26 |
| 10,030,497 | B2 * | 7/2018 | Dawson | E21B 43/126 |
| 10,260,335 | B2 * | 4/2019 | Chia | E21B 47/123 |
| 2001/0020675 | A1 | 9/2001 | Tubel et al. | |
| 2002/0027004 | A1 | 3/2002 | Bussear et al. | |
| 2008/0295492 | A1 | 12/2008 | Karkkainen et al. | |
| 2016/0186543 | A1 | 6/2016 | Ayres | |
| 2019/0330939 | A1 * | 10/2019 | Fontenot | E21B 41/02 |

OTHER PUBLICATIONS

International Search Report and Written Opinion, International Application No. PCT/US2018/054788 dated Feb. 11, 2019.

* cited by examiner

*Primary Examiner* — Daniel P Stephenson
(74) *Attorney, Agent, or Firm* — Richard A. Fagin

(57) ABSTRACT

A method for injecting a controlled volume of liquid into a system having at least one liquid injection point includes inputting into a controller pressure measurements made at at least one position from a liquid storage device and the at least one injection point. The controller automatically causes a liquid injector to inject the liquid for a time duration corresponding to a predetermined liquid volume. The time duration is adjusted in relation to the measurements of pressure.

17 Claims, 1 Drawing Sheet

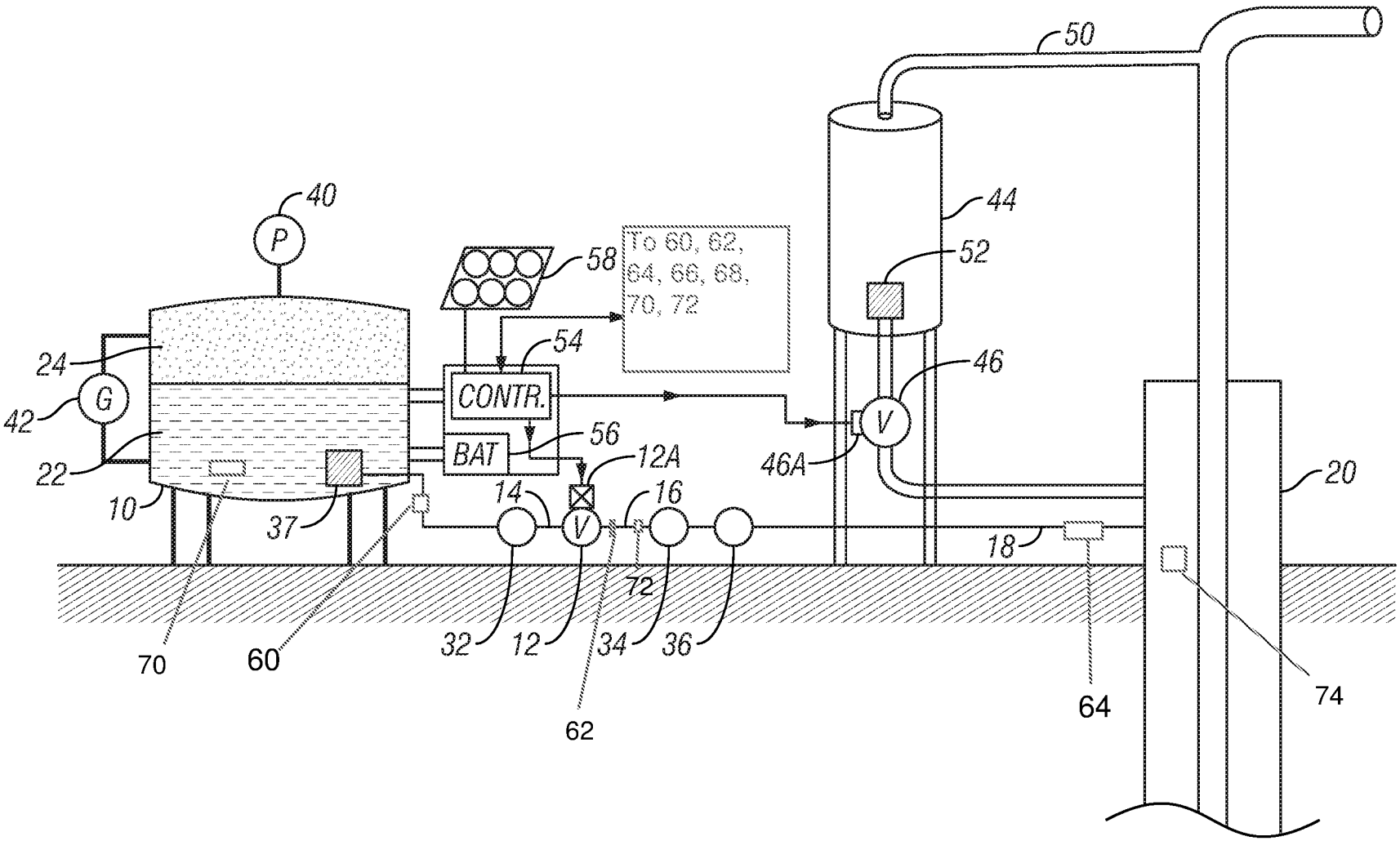
20
74
50
64
18
44
52
46
V
46A
To 60, 62, 64, 66, 68, 70, 72
36
16
72
34
62
12A
56
V
12
58
54
CONTR.
BAT
14
32
40
P
37
60
70
10
24
G
42
22

METHOD AND APPARATUS FOR AUTONOMOUS INJECTABLE LIQUID DISPENSING

CROSS REFERENCE TO RELATED APPLICATIONS

Not Applicable.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of chemical treatment of subsurface wells, tank farms, tank batteries, and product transportation pipelines, although uses for devices in this disclosure are not limited to the foregoing. More specifically, the disclosure relates to apparatus for dispensing well treatment chemicals using pressurized gas as a dispensing mechanism, although the disclosure is not limited to such apparatus.

U.S. Pat. No. 9,488,041 issued to Ayres discloses a well chemical treatment system including a chemical dispenser having a control signal input and a chemical outlet in fluid communication with a well. A chemical dispenser controller operates the dispenser and detects a well fluid lift pump controller signal. The chemical dispenser controller transmits a control signal to the chemical dispenser at selected times and is configured to increment the counter and inhibit transmission of the control signal when a selected time occurs and a pump in operation signal is not detected. When the chemical dispenser controller detects a pump in operation signal at one of the selected times, the chemical dispenser controller sends a control signal to the chemical dispenser to dispense an amount of chemical into the well equal to a product of a number in the counter plus one and an amount of chemical to be dispensed into the well at each selected time.

The chemical dispenser disclosed in the '041 patent comprises a pressure vessel closed to atmospheric pressure and a pressurized gas located in the pressure vessel. The chemical dispenser comprises a valve controlled by the chemical dispenser controller, wherein pressure exerted by the pressurized gas causes the chemical to flow from the pressure vessel to the well through the valve. The amount of chemical dispensed each time the valve is opened is related to pressure in the pressure vessel as may be adjusted by a pressure regulator, pressure in the well, flow characteristics of flow lines and other equipment forming the chemical flow path between the valve and the well, and the fluid (rheological) properties of the chemical. For any given values of the foregoing parameters, the amount of chemical dispensed is related to the amount of time the valve is open.

Over time, the rheological properties of the chemical or any other injectable liquid may change. Physical properties of the injection system may also change, e.g., pressures, temperatures and flow restrictions in the injection system Thus, the amount of chemical or other injectable liquid dispensed during each operation of the valve may change for any fixed valve opening time at each operation. It is desirable to have a device by which the amount of chemical dispensed during each valve operation is automatically adjusted to compensate for such changes in rheological properties and physical properties of the injection system.

SUMMARY

A method for injecting a controlled volume of liquid into a system having at least one liquid injection point includes measuring at least at at least one position between a liquid storage device and the at least one injection point. The controller automatically causes a liquid injector to inject the liquid for a time duration corresponding to a predetermined liquid volume, the time duration adjusted in relation to the measurement of at least pressure.

In some embodiments, the controller operates a first control valve to be open for the time duration.

In some embodiments, the liquid injection apparatus comprises a vessel having the liquid therein stored at a pressure greater than a pressure at the at least one injection point.

In some embodiments, at least one injection point comprises a subsurface well.

In some embodiments, the relationship comprises, specific gravity and/or viscosity of the liquid.

In some embodiments, flow characteristics of the liquid injection apparatus comprising at least one of flow coefficient, discharge coefficient, orifice diameter, size of transport conduits and resistance of the transport conduits is entered into the controller to further adjust the time duration.

In some embodiments, temperature is measured at at least one location between the liquid storage device and the injection point. The temperature measurements are input to the controller to further adjust the time duration.

In some embodiments, the measuring pressure comprises measuring pressure at the injection point.

A liquid injection system according to another aspect includes a liquid injector fluidly coupled to an injection point in a system. At least one pressure is arranged to measure pressure or temperature at a selected position between the liquid injector and the system. A controller is in signal communication with the at least one pressure sensor and with the liquid injector. The controller is arranged to operate the liquid injector for a selected time to inject a predetermined volume of liquid into the system. The controller is operable to adjust the selected time in response to measurements made by the at least one pressure sensor.

In some embodiments, the liquid injector comprises a vessel having liquid therein stored at a pressure greater than a pressure at the at least one injection point. In some embodiments, the liquid injector further comprises a first control valve fluidly connected between an outlet of the vessel and the injection point. The controller in such embodiments is operable to open the first control valve for the selected time.

In some embodiments, at least one injection point comprises a subsurface well.

In some embodiments, the controller comprises instructions including a relationship comprising specific gravity and/or viscosity of the liquid with respect to at least one of temperature and pressure.

In some embodiments, a temperature sensor is arranged to measure temperature at at least one location between the liquid storage device and the injection point and to communicate the temperature measurements to the controller. The controller includes instructions to further adjust the time duration in response to the temperature measurements.

In some embodiments, the controller comprises instructions including flow characteristics of the liquid injector, the characteristics comprising at least one of flow coefficient, discharge coefficient, orifice diameter, size of transport conduits and resistance of the transport conduits.

In some embodiments, the at least one of a temperature and a pressure sensor is disposed at the injection point.

BRIEF DESCRIPTION OF THE DRAWINGS

FIG. 1 shows an example embodiment of an autonomous treatment system according to the present disclosure.

DETAILED DESCRIPTION

An example embodiment of a fluid injection system, which in the present embodiment may be a treatment chemical injection system that may be used in accordance with the present disclosure is shown schematically in FIG. 1. A chemical dispenser vessel ("vessel") 10 may be substantially as described in U.S. Pat. No. 5,209,300 issued to Ayres. The vessel 10 is distinguishable from containers such as tanks which may only be designed to withstand the hydrostatic pressure exerted by fluid in the tank. The vessel 10 may be made from glass, carbon or composite fiber reinforced plastic, from stainless steel, or from any other material which is resistant to degradation induced by chemicals and corrosive gases. In some embodiments, the vessel 10 may include an inner lining (not shown) resistant to chemical attack. A first control valve 12, which in the present embodiment may be actuated by an actuator 12A, which may be a solenoid operated valve or the like, has an inlet end 14 in fluid communication with the interior of the vessel 10. An outlet end 16 of the first control valve 12 is connected to one end of a fluid injection line 18. The other end of the fluid injection line 18 is coupled to an injection point, which in the present example embodiment may be a subsurface well ("well") 20. In some embodiments, the actuator 12A can be a motor/gear set.

While the present example embodiment of a fluid injection system is described in terms of a pressure vessel used to store well treatment chemical, along with corresponding equipment consisting of the first control valve 12, in other embodiments the foregoing components may be substituted by, for example and without limitation a storage tank and a pump to withdraw fluid from the tank and move the fluid under pressure to the well 20. Other structures known in the art for delivering predetermined amounts of fluid from a storage container to an injection point at selected times are within the scope of the present disclosure, for example and without limitation a chemical pump.

Although the well 20 may be a hydrocarbon producing well, the present example embodiment is useful for other types of wells relating to the production of hydrocarbons such as injection wells used in enhanced recovery operations. As used throughout this disclosure, the terms "well" and "hydrocarbon producing well" can include all wells directly or incidentally associated with the production from or injection of fluids into subsurface Earth formations. Furthermore, uses for an apparatus and method as disclosed herein as well as the term "injection point", although described in terms of a subsurface well, are not limited to use with or in a subsurface well. Other uses may comprise, without limitation, material transportation pipelines, conduits in refineries and chemical processing plants, and other uses wherein fluid is moved, transported and/or stored in conduits and/or tanks and vessels and is injected at one or more selected points.

An injectable liquid 22, for example, a treating chemical, may be contained in the vessel 10 in liquid form. It is within the scope of the present disclosure that the injectable liquid 22 can comprise any liquid compound or material that can be injected into one or more injection points, which in the present example embodiment may comprise the well 20. As representative examples, without limiting the scope of the present disclosure, the injectable liquid 22 can comprise chemicals generally identified as corrosion/scale inhibitors, water clarifiers, demulsifiers, and other chemicals which inhibit the formation of chemical, organic, or metallic compounds in hydrocarbon producing wells. An injection point, as explained above, may be, without limitation, suitable places within material transportation pipelines, conduits in refineries and chemical processing plants, and other uses wherein fluid is moved, transported and/or stored in conduits and/or tanks and vessels where treatment chemical or other injectable liquid may be desirable to be used.

As shown in FIG. 1, a pressurized gas 24 is also disposed in the vessel 10. The pressurized gas 24 ("gas") may include one or more chemically inert gases, which do not chemically react with the injectable liquid 22. The gas 24 may comprise readily available inert gases such as nitrogen, helium, argon or carbon dioxide. The pressurized gas 24 is initially charged to a pressure which is less than the condensation pressure for such gas. The condensation pressures are commonly known for each gas, and are not exceeded within the vessel 10 to prevent the mixing, in the liquid phase, of the pressurized gas 24 with the injectable liquid 22. In addition, the density of pressurized gas 24 is preferably less than the density of the injectable liquid 22 so that the injectable liquid 22 is concentrated toward the bottom of the vessel 10, and the pressurized gas 24 is concentrated toward the top of the vessel 10. As shown in FIG. 1, the pressurized gas 24 is in contact with the injectable liquid 22 and pressurizes the injectable liquid 22 to the same pressure as that of the pressurized gas 24.

Also s shown in FIG. 1, a first pressure regulator 32 may be installed between the outlet of the vessel 10 and an inlet 14 of the first control valve 12. The first pressure regulator 32, if used, controls the pressure of the injectable liquid 22 which is communicated to the inlet 14 of the first control valve 12. In some embodiments, the first regulator 32 may not reduce the pressure of the injectable liquid 22 below the pressure in well 20 because this would prevent the injectable liquid 22 from entering the well 20. To prevent the accidental or inadvertent backflow of well fluids into the fluid line 18, a check valve 36 may be installed in the fluid injection line 18. The control of the pressure differential across the first control valve 12 may be used in some embodiments because the flow rate through certain types of valves depends on the size of the valve orifice, the pressure differential between the valve inlet and outlet and the rheological properties of the injectable liquid 22.

In the present embodiment, a first pressure sensor 60 may be in pressure communication with the fluid injection line 18, for example, at a position ahead of the first pressure regulator 32. In some embodiments, a second pressure sensor 62 may be in pressure communication with the fluid injection line 18 on the outlet side of the first pressure regulator 32. In some embodiments, the second pressure sensor 62 may substitute for the first pressure sensor 60 entirely. In some embodiments, a third pressure sensor 64 may be disposed at any other selected position along and in pressure communication with the fluid injection line 18 between the first control valve 12 and the well 20. The third pressure sensor 64 in some embodiments may substitute entirely for the second pressure sensor 62. Any or all of the first 60, second 62 and third 64 pressure sensors may be in signal communication with a controller 54 to be explained further below. In general, at least one pressure sensor may be located at any position between the vessel 10 and the well 20 in order to cause certain operation by the controller 54.

In some embodiments, such as the example embodiment shown in FIG. 1, a second regulator 34 may be located between the first control valve 12 and the well 20. The first control valve 12, the first regulator 32, and the second regulator 34, when used, are each in fluid communication with the interior of the vessel 10 and the well 20. In the present embodiment, any pressure fluctuations in the vessel 10 and in the well 20 may thus be isolated from the first control valve 12.

In operation, the first control valve 12 is initially closed to prevent the release of the injectable liquid 22 from the vessel 10. The first control valve 12 is then selectively opened and the pressurized gas 24 urges the injectable liquid 22, in some embodiments through the first regulator 32, the first control valve 12, the second regulator 34, and through the fluid injection line 18, and into the well 20. In some embodiments, any or all of the first regulator 32, the check valve 36 and the second regulator 34 may be omitted.

The opening of the first control valve 12 may be timed to selectively control the flow of injectable liquid 22 into the well 20. The first control valve 12 can be operated at selected durations of time to selectively increase or decrease the amount or volume of the injectable liquid 22 injected into the well 20. The precise injection amount of the injectable liquid 22 may accomplish several objectives. Certain wells may require large volumes of injectable liquids to obtain a desired function. Other wells may require only relatively small quantities of injectable liquids to accomplish the desired results. For example, certain wells may require only a fraction of a gallon per day to accomplish the desired result, and the injection of additional injectable liquids is unnecessary to the operation of the well. If more injectable liquid than required is injected into the well, then the excess injectable liquid is superfluous to the operation of the well and results in additional cost to the operator. The present embodiment may selectively control the flow amount of the injectable liquid 22 and may eliminate unnecessary injectable liquid use. In the present embodiment, the duration of each operation of the first control valve 12 may be in response to measurements made by any or all of the first 60, second 62 and/or third 64 pressure and/or temperature sensors The apparatus of the present embodiment may be configured to control the flow of injectable liquid 22 by selecting the operating time and frequency of operation of the first control valve 12 to obtain any injectable liquid amount or volume, ranging from essentially a continuous discharge of the injectable liquid 22 from the vessel 10. Any amount even as small as one one-thousandth of a gallon per day or less or more is possible.

As previously explained, in some embodiments the check valve 36 may also be installed in the injection line 18 to prevent the backflow of fluids in the well 20 into the first control valve 12 or the vessel 10. This feature is desirable because a well operator could accidentally pressurize well 20 to a pressure higher than that of the injectable liquid 22 in the vessel 10. In some embodiments, the foregoing function could be incorporated into the design of the first control valve 12.

In some embodiments, a low level indicator 37, for example a float or similar device may be located in the vessel 10 to prevent the pressurized gas 24 from exiting the vessel 10. The low level indicator 37, if a float is used, may have a density less than that of the injectable liquid 22 and is thereby buoyant therein. As the level of injectable liquid 22 is lowered in the vessel 10 by releasing the injectable liquid 22 through the first control valve 12, the low level indicator 37, if a float is used, will be lowered in the vessel 10. When the low level indicator 37, if a float is used, reaches a selected position within the vessel 10, the low level indicator 37 may seal the outlet of the vessel 10 to prevent the release of the pressurized gas 24 from the vessel 10. The foregoing function can be performed other than by using the liquid level sensor 37. For example, a liquid level sensor 42 such as a capacitance sensor or acoustic level sensor may be used to indicate the level of the injectable liquid 22 within the vessel 10 so that an operator could visually check the level of the injectable liquid 22. In other embodiments, mechanical, electrical, or electronic equipment could be used to indicate the level of the injectable liquid 22 within the vessel 10 or, in some embodiments, to seal the outlet when the level of the injectable liquid 22 in the vessel is lowered to a certain position. A pressure sensor 40 can be attached to or disposed in the vessel 10 to measure the pressure of the pressurized gas 24. A liquid level sensor 42 can be attached to the vessel 10 for measuring the quantity of the injectable liquid 22 in the vessel 10. The liquid level sensor 42 can comprise many different embodiments such as sight glasses, electromagnetic switches, and other devices well-known in the art. In addition, the liquid level sensor 42 could comprise a flow meter which measures the quantity of fluid flowing from the vessel 10. When the liquid quantity flowing from the vessel 10 is compared to the quantity of the injectable liquid 22 initially installed in the vessel 10, the quantity of the injectable liquid 22 in the vessel 10 at any point in time can be determined.

In the present embodiment the first control valve 12 can be operated electrically, such as by the actuator 12A. The actuator 12A can be operated by the controller 54, which may be of any type known in the art, such as a programmable logic controller, microprocessor, programmable logic gate array or any other device known to be used for electronic, electromechanical or mechanical control of operation of a process operating device such as valves. The controller 54 may be supplied with electrical power by a battery 56. The battery 56 may be recharged by a solar cell 58. The foregoing electrical power to operate the controller 54 and the actuator 12A are not intended to ultimately limit the scope of the disclosure, but are preferred for economy and reliability of operation.

The present embodiment may include a fluid storage tank 44. The fluid storage tank 44 receives produced fluid from the well 20 through a flowline 50 coupled to an outlet of the well 20. The fluid storage tank 44 is preferably made so that it can hold internal pressure equal to the pressure at the outlet of the well 20. As fluid is produced from the well 20, some of it will enter the flowline 50 and ultimately fill the tank 44. The fluid storage tank 44 may include at its discharge end a float 52 similar in operation to the low level indicator 37 on the vessel 10. The outlet of the fluid tank 44 is in hydraulic communication with the well 20 through a second control valve 46 operated by a motor/gear set 46A. It has been determined through experimentation with various types of valve actuators that using a motor/gear set to actuate the second control valve 46 reduces the incidence of improper valve operation due to contamination of the valve from materials present in the fluid produced from the well. A motor/gear set may also be less susceptible to the second valve 46 being improperly opened by high pressures extant on the outlet side of the second control valve 46. The motor/gear set 46A can also be operated by the controller 54. When the second control valve 46 is operated, fluid in the tank 44 may flow into the well 20. By having equal pressure on the well 20 and the tank 44, fluid in the tank 44 may simply flow by gravity into the well 20. In some embodiments the tank 44 is not used and the line 18 may be connected directly to the second control valve 46 to obtain a the above functionality.

In the present embodiment, the controller 54 may be programmed to operate the first control valve 12 to selectively discharge a predetermined volume of the injectable liquid 22, and the second control valve 46 may be used to allow movement into the well 20 of fluid stored in the tank 44 at selected times and for selected durations. Operating the first control valve 12, as previously explained, causes injection of a selected amount of the injectable liquid 22 into the well 20. At substantially the same time, operation of the second control valve 46 causes the contents of the fluid storage tank 44, if used, to flow by gravity into the well 20. Thus, a chemical treatment is supplied to the well 20 that is already dispersed in fluid (which may include oil and/or water) prior to reaching the bottom of the well 20, in the event the fluid level in the well 20 is too low to properly disperse the injectable liquid 22 by itself. In other implementations, the second control valve 46 may not be operated, allowing only treatment injectable liquid to be dispensed into the well 20.

In some embodiments, the float 52 may include a switch (not shown separately) so that the controller 54 will not operate the first and second control valves 12, 46 if the level of fluid in the tank 44 falls below a selected level. In some embodiments, the second control valve 46 can be operated to discharge essentially the entire contents of the fluid storage tank 44 at each operation. In some embodiments, the second control valve 46 can be operated to discharge a selected amount of the contents of the fluid storage tank 44. In some embodiments, the first regulator 32, second regulator 34 and/or the check valve 36 may be omitted. Additionally, the controller 54 may be programmed to operate the first control valve 12 and the second valve 46 with respect to any timing reference, such as during periods of time in which a pump (not shown) is operating to lift fluids out of the well 20, or at times during which the pump (not shown) is not operating. In some embodiments, the controller 54 can be programmed to operate the first and second control valves 12, 46, respectively, simultaneously, or at different times from each other.

In the present embodiment, pressure measurements made by at least the first pressure sensor 60, and in some embodiments the second 62 and/or third 64 pressure sensor may be used by the controller 54 to calculate the amount of time the first control valve 12 remains open (an actuation of the valve) and correspondingly operate the first control valve 12 at each time injectable liquid 22 is to be dispensed into the well 20. In some embodiments, a difference between pressure measured by the first pressure sensor 60, and the second pressure sensor 62 and/or the third pressure sensor 64 may be used to infer changes in flow rate when also factoring in liquid characteristics, for example viscosity and/or specific gravity of the injectable liquid 22, and thus may be used by the controller 54 to extend or reduce the operating time in any actuation of the first control valve 12. In some embodiments, wherein the second pressure sensor 62 substitutes for the first pressure sensor 60, and thus measures pressure after the first regulator 32, a difference between pressure measured by the second pressure sensor 62 and the third pressure sensor 64 may be used by the controller 54 to adjust the operating time of the first control valve 12 in any actuation thereof. In some embodiments, sensors may comprise a first temperature sensor 70 disposed in the injectable liquid 22 in the vessel 10, a second temperature sensor 71 proximate the controller 54, a third temperature sensor 72 disposed in the fluid injection line 18 downstream of the first control valve 12 and a fourth temperature sensor 74 proximate the injection point, which in the present embodiment may be the well 20. At a minimum, at least one pressure measurement is made at at least one location between the injectable liquid storage (e.g., the vessel 10) and the injection point (e.g., the well 20) and such measurement is conducted to the controller 54. The controller 54 uses such pressure measurement to autonomously adjust or control the operating time (time duration) of the first control valve 12 in response to the pressure measurements while factoring in previously described characteristics of the injectable liquid and injection system.

In the present example embodiment, the controller 54 may use temperature and pressure characteristics of the injectable liquid 22, for example, its viscosity and/or specific gravity with respect to temperature and pressure to autonomously adjust or control the amount of time the first control valve 12 is operated at any one or more dispensing (injecting) times to inject a corresponding amount of the injectable liquid 22. In some embodiments, the foregoing measurements may be used separately or in any combination by the controller 54 to adjust the amount of time so as to inject a substantially constant amount of injectable liquid at each injection time. Measurements of pressure made by the various pressure sensors (e.g., 60, 62, 64) may be used by the controller 54 to autonomously control the first control valve 12 operating time in response to changes in pressure at the various pressure measurement locations Equipment characteristics may be input to the controller 54; such characteristics may include but are not limited to flow coefficient, discharge coefficient, orifice diameters, size of hose or transport conduits and resistance of the conduits. Equipment characteristics as used herein may apply to but are not limited to any one or more of the inlet end 14, the outlet end 16, the fluid injection line 18, the first control valve 12, the first regulator 32, the second regulator 34 and/or the check valve 36.

Measurements may include but are not limited to; pressure made by sensors 60, 62 and/or 64 and temperature measurements made by sensors 70, 71, 72 and/or 74 or any combination of the foregoing.

Liquid injection process control may comprise four phases. In the present example embodiment, the phases may include pre-injection, actuation, injection and post injection. The controller 54 monitors and stores measurements in real time from measurements made by the above described sensors, injectable liquid. Equipment characteristics are used to make calculations and adjustments as needed during each phase.

The controller 54 operates dynamically and adjusts parameters including the first control valve 12 operating time (i.e., open duration) at each injection time without user input or intervention after the system shown in FIG. 1 is started.

In one example embodiment, the injectable liquid properties (e.g., specific gravity, temperature, viscosity) have changed from an earlier liquid injection time, however, the equipment characteristics and sensor measurements are the same as at the earlier injection time. For example, the vessel 10 may have more viscous liquid stored therein as compared to that at the earlier time. Such may be the case when the injectable liquid composition has changed. Having a more viscous liquid properties stored in the controller 54, the first control valve 12 operating time would automatically be changed (without user intervention) to perform longer injection duration than at the earlier time to inject same volume of the injectable liquid 22.

In one example embodiment, the pressure at the injection point (e.g., at the well 20) is/are different than at an earlier injection time. For example, at a certain injection time higher injection point (e.g., well) pressure may be higher than at an earlier injection time. The controller 54 may automatically adjust the operating time of the first control valve 12 (without user intervention) to open the first control valve 12 for a longer injection duration compared to the pressure at the earlier time, because the increased pressure at the injection point would require a longer valve open duration to inject the same volume of liquid as at the earlier injection time.

In one embodiment, the equipment characteristics have varied (e.g., flow coefficient, discharge coefficient, size of hose or medium transportation resistance) from those at an earlier injection time. For example, at a selected injection time, the system shown in FIG. 1 may have more restrictive hose and/or transportation medium than at the earlier injection time. The controller 54 may automatically adjust the operating time of the first control valve 54 (without user intervention) to provide a longer injection duration as compared to the earlier injection time, to inject the same volume of injectable liquid than at the earlier injection time.

Any combination of the above scenarios, i.e., example embodiments, may be handled by the controller 54 to obtain consistent injected volume amount of injectable liquid 22 notwithstanding changes in injectable liquid properties, fluid flow properties of the injection system and/or environmental conditions such as injection point pressure, fluid and/or injection point temperature.

Although only a few example embodiments have been described in detail above, those skilled in the art will readily appreciate that many modifications are possible in the examples. Accordingly, all such modifications are intended to be included within the scope of this disclosure as defined in the following claims.

What is claimed is:

1. A method for injecting a controlled volume of liquid into a system having at least one liquid injection point, the method comprising:

measuring at least pressure at at least one position between a liquid storage device and the at least one injection point;

communicating the measured pressure to a controller, the controller comprising as input fluid flow characteristics of a liquid injection apparatus, a relationship between pressure and at least a viscosity of the liquid at a predetermined pressure and temperature; and operating the controller to automatically cause a liquid injector to inject the liquid for a time duration corresponding to a predetermined liquid volume, the time duration adjusted in relation to the measurements of at least the pressure, the characteristics and the relationship.

2. The method of claim 1 wherein the controller operates a first control valve to be open for the time duration.

3. The method of claim 2 wherein the liquid injection apparatus comprises a vessel having the liquid therein stored at a pressure greater than a pressure at the at least one injection point.

4. The method of claim 1 further comprising measuring temperature at at least one position between a liquid storage device and the at least one injection point, conducting the temperature measurements to the controller and causing the controller to further adjust the time duration in response to the temperature measurements.

5. The method of claim 1 wherein the at least one injection point comprises a subsurface well.

6. The method of claim 1 wherein the relationship comprises specific gravity and/or viscosity of the liquid.

7. The method of claim 1 wherein the flow characteristics of the liquid injection apparatus comprise at least one of flow coefficient, discharge coefficient, orifice diameter, size of transport conduits and resistance of the transport conduits.

8. The method of claim 1 wherein the measuring pressure comprises measuring pressure at the injection point.

9. The method of claim 1 wherein the liquid comprises at least one of a corrosion inhibitor, a scale inhibitor, a water clarifier, a demulsifiers, and a chemical which inhibits formation of chemical, organic, or metallic compounds in a hydrocarbon producing well.

10. A liquid injection system, comprising:

a liquid injector fluidly coupled to an injection point in a system;

at least one of pressure sensor disposed at a selected position between the liquid injector and the system; and a controller in signal communication with the at least one of pressure sensor and with the liquid injector, the controller arranged to operate the liquid injector for a selected time to inject a predetermined volume of a liquid into the system, the controller operable to adjust the selected time in response to measurements made by the at least one pressure sensor, the controller further comprising instructions including a relationship comprising specific gravity and/or viscosity of the liquid with respect to at least pressure, the controller arranged to further adjust the selected time in response to the relationship and measurements made by the at least a pressure sensor.

11. The system of claim 10 wherein the liquid injector comprises a vessel having liquid therein stored at a pressure greater than a pressure at the at least one injection point.

12. The system of claim 11 wherein the liquid injector further comprise a first control valve fluidly connected between an outlet of the vessel and the injection point, the controller operable to open the first control valve for the selected time.

13. The system of claim 10 wherein the at least one injection point comprises a subsurface well.

14. The system of claim 10 wherein the controller comprises instructions to use input including flow characteristics of the liquid injector, the characteristics comprising at least one of flow coefficient, discharge coefficient, orifice diameter, size of transport conduits and resistance of the transport conduits to further adjust the selected time.

15. The system of claim 10 wherein the at least one a pressure sensor is disposed at the injection point.

16. The system of claim 10 further comprising at least one temperature sensor disposed at least one position between a liquid storage device and the at least one injection point, the at least one temperature sensor in signal communication with the controller, the controller arranged to further adjust the selected time in response to measurements made by the at least one temperature sensor.

17. The system of claim 10 wherein the liquid comprises at least one of a corrosion inhibitor, a scale inhibitor, a water clarifier, a demulsifiers, and a chemical which inhibits formation of chemical, organic, or metallic compounds in a hydrocarbon producing well.

* * * * *